US009068295B2

(12) United States Patent
Rutz et al.

(10) Patent No.: US 9,068,295 B2
(45) Date of Patent: Jun. 30, 2015

(54) SYSTEM AND METHOD FOR LAYING DOWN AND COMPACTING AN ASPHALT LAYER

(75) Inventors: Arnold Rutz, Ludwigshafen (DE); Achim Eul, Mannheim (DE); Martin Buschmann, Neustadt (DE); Ralf Weiser, Ladenburg (DE)

(73) Assignee: Joseph Vogele AG, Ludwigshafen am Rhein (DE)

( * ) Notice: Subject to any disclaimer, the term of this patent is extended or adjusted under 35 U.S.C. 154(b) by 0 days.

(21) Appl. No.: 13/445,305

(22) Filed: Apr. 12, 2012

(65) Prior Publication Data

US 2012/0263531 A1 Oct. 18, 2012

(30) Foreign Application Priority Data

Apr. 18, 2011 (EP) ..... 11003244

(51) Int. Cl.

| | |
|---|---|
| ***E01C 23/01*** | (2006.01) |
| ***G01N 9/36*** | (2006.01) |
| ***E01C 19/00*** | (2006.01) |
| ***E01C 19/23*** | (2006.01) |
| ***E01C 19/48*** | (2006.01) |

(52) U.S. Cl.
CPC ..... *E01C 19/00* (2013.01); *E01C 19/23* (2013.01); *E01C 19/48* (2013.01)

(58) Field of Classification Search
USPC ..... 404/84.1, 118, 102; 702/137
IPC ..... E01C 23/01; G01N 9/36
See application file for complete search history.

(56) References Cited

U.S. PATENT DOCUMENTS

| | | | | |
|---|---|---|---|---|
| 3,608,446 | A | 9/1971 | Plant | |
| 5,100,277 | A | 3/1992 | Musil | |
| 5,385,426 | A * | 1/1995 | Omann | 404/75 |
| 5,471,391 | A | 11/1995 | Gudat et al. | |

(Continued)

FOREIGN PATENT DOCUMENTS

| | | |
|---|---|---|
| CN | 1246563 A | 3/2000 |
| DE | 69416006 D1 | 2/1999 |

(Continued)

OTHER PUBLICATIONS

Office action which issued on Apr. 2, 2014 in corresponding Chinese Application No. 201210115686.X, with English portion of relevant sections thereof.

(Continued)

*Primary Examiner* — Gary Hartmann
(74) *Attorney, Agent, or Firm* — Fish & Richardson P.C.

(57) ABSTRACT

In a system for laying down an asphalt layer made of asphalt material, and having a road paver having a screed with compacting tools, a compacting device and a mixer, an electronic material density module is provided in or for the road paver. The electronic material density module obtains data during the laying process regarding at least the actual degree of compaction of the asphalt layer produced in the area of at least one compacting tool and evaluates and/or documents these data at least for operational optimisation and/or operational monitoring of the road paver and/or compacting device and/or mixer. The data obtained is communicated to the compacting device that produces the final degree of compaction of the asphalt layer based on the data and on the actual degree of compaction determined at the screed.

12 Claims, 3 Drawing Sheets

(56) References Cited

U.S. PATENT DOCUMENTS

| | | | | |
|---|---|---|---|---|
| 5,493,494 | A | 2/1996 | Henderson | |
| 5,942,679 | A | 8/1999 | Sandstrom | |
| 6,122,601 | A * | 9/2000 | Swanson et al. | 702/137 |
| 6,238,135 | B1 | 5/2001 | Rower | |
| 6,460,006 | B1 * | 10/2002 | Corcoran | 702/137 |
| 6,551,019 | B1 * | 4/2003 | Motz et al. | 404/117 |
| 6,749,364 | B1 | 6/2004 | Baker et al. | |
| 7,226,239 | B2 * | 6/2007 | Stridiron et al. | 404/84.1 |
| 7,575,395 | B2 * | 8/2009 | Stridiron et al. | 404/84.1 |
| 7,591,608 | B2 * | 9/2009 | Hall et al. | 404/84.1 |
| 8,099,218 | B2 | 1/2012 | Glee et al. | |
| 8,112,242 | B2 * | 2/2012 | Troxler | 702/127 |
| 8,116,950 | B2 * | 2/2012 | Glee | 701/50 |
| 8,371,770 | B1 * | 2/2013 | Rasmusson et al. | 404/102 |
| 8,454,266 | B2 * | 6/2013 | Buschmann et al. | 404/72 |
| 8,591,146 | B2 * | 11/2013 | Begley et al. | 404/108 |
| 8,682,605 | B2 * | 3/2014 | Troxler | 702/137 |
| 2009/0142133 | A1 | 6/2009 | Glee et al. | |

FOREIGN PATENT DOCUMENTS

| | | | |
|---|---|---|---|
| DE | 20010498 | U1 | 11/2000 |
| DE | 102008058481 | A1 | 7/2009 |
| EP | 698152 | A1 | 2/1996 |
| EP | 733231 | B1 | 1/1999 |
| JP | 02530000 | Y2 | 3/1997 |

OTHER PUBLICATIONS

A European Search Report mailed Oct. 28, 2011, which issued in corresponding EP Application Serial No. 11003247.1.

A European Search Report mailed Oct. 4, 2011, which issued in corresponding EP Application Serial No. 11003244.8.

* cited by examiner

SYSTEM AND METHOD FOR LAYING DOWN AND COMPACTING AN ASPHALT LAYER

BACKGROUND OF THE INVENTION

The invention relates to a system and method for laying down and compacting an asphalt layer.

In a system disclosed in DE 10 2008 058 481 A, a position temperature model of the construction site is generated and communicated to compacting devices in order to prevent a compacting device from then carrying out the final compacting at a position of the asphalt layer that has been laid down if a temperature range that is unsuitable for compacting prevails in this position.

EP 0 733 231 B1 (DE 694 16 006 T2) discloses a mobile compacting device that is guided, using a digitalised desired site model in comparison to a likewise digitalised actual site model in which desired degrees of compaction and actual degrees of compaction are depicted, onto asphalt that has been laid down. The respective actual degree of compaction is determined beforehand, e.g., by expert appraisals. The compacting device optionally passes over a test surface in order to determine the compaction power and/or the number of necessary passages needed for the final compacting.

In a method for controlling a mobile compacting device disclosed in EP 0 698 152 B1 the actual degree of compaction in the asphalt layer is determined by the compacting device itself at the position that is to be compacted, and the compaction power is adjusted directly with a view to the desired final degree of compaction. Because the actual degree of compaction is not determined until the respective position has been reached, it is scarcely possible to react with sufficient rapidity to unavoidable changes in the actual degree of compaction.

In practice, it is furthermore customary for the personnel to optimise operational parameters of the road paver and/or of the screed according to experience and an inspection of the asphalt layer that has been laid down, or to resort to estimates or rule of thumb values for this purpose. Due to the multiplicity of influences that have to be taken into account thereby, this approach is time-consuming and the result is often unsatisfactory and in need of correction (trial and error method).

SUMMARY OF THE INVENTION

The object of the present invention is to provide an economical and efficient system and a method for laying down an asphalt layer, with which system and method the actual compaction produced by the road paver can be better taken into consideration for general operational optimisation and for monitoring at the construction site in order to achieve a high final degree of compaction in the asphalt layer that is as uniform as possible.

The set object is solved with the features of the present invention.

The material density module obtains the respective actual degree of compaction produced by at least one compaction tool of the screed while the asphalt is being laid down, evaluates this value, and consequently provides meaningful information that can be used for general operational optimisation and/or operational monitoring, whereby either the operation of the road paver can be directly optimised and monitored or the road paver, as the central producer of the asphalt layer, can guide peripheral accessory devices also with a view to their operational optimisation (pull principle). It is, e.g., consequently possible to provide the compacting device with position data and the respective determined actual degree of compaction in such a way that this device, based on the actual degree of compaction and in spite of fluctuations in the actual degree of compaction, later produces only the compaction power at this position that produces the desired final degree of compaction, i.e., neither does it produce excessive compaction power that could result in an inexpedient waste of energy or even damage to the asphalt layer nor does it compact too little, which would reduce the load-bearing capacity of the asphalt layer. The material density module informs the compacting device of which compaction power and/or how many passages are needed at the respective position in good time, allowing the compacting device to be driven and adjusted accordingly without there being a shortage of time. Alternatively or additionally, by means of the material density module, the mixer can be supplied with information on the basis of which alarm messages can be triggered if the value(s) determined on the road paver for the composition (formulation) and/or temperature of the delivered asphalt material fall(s) short of or exceed(s) limits. The composition of the asphalt material can then also be immediately adjusted in the mixer, e.g., with a view to better workability and/or another composition, i.e., with only the delay caused by the supply chain to the road paver. As a result, a qualitatively premium asphalt layer can be laid down economically and efficiently, because the material density module functions as a guiding element of a construction site management system (site management).

According to the method, the information regarding the actual degree of compaction produced by the compacting tools of the screed of the road paver and required for economical and efficient operation of the at least one compacting device does not have to be imprecisely estimated or determined on the compacting device separately and not until relatively late, because it is already available early on while the road paver is working. This simplifies the operating sequence significantly and results in a constantly high final degree of compaction, which is one of the fundamental command variables in the asphalting process. Because a sufficiently high and uniform final degree of compaction is a prerequisite for the street or traffic area being in a position to show its desired properties, particularly the load-bearing capacity, i.e., the ability to absorb the loads that arise with traffic and conduct them into the foundation without deforming the asphalt layer that was laid down and, e.g., forming ruts. Because the actual degree of compaction achieved during the laying process with the screed can change due to various factors, it is important during the subsequent compaction at the respective position that the compacting device produces only the compaction power that is still required for achieving the desired final degree of compaction. For example, the compaction to the final degree of compaction takes place by means of rolling compaction, i.e., e.g., by means of static gravitational or vibratory or oscillation compaction. Compacting devices such as asphalt rollers compact in two stages per passage, because they have two drums or wheel sets. Furthermore, unlike the road paver, rollers usually pass over each position of the asphalt layer multiple times, so that it is significantly advantageous to carry out the final compaction exactly, taking into consideration the actual compaction produced and communicated by the compacting tools of the screed. Using the material density module furthermore makes it possible very efficiently to optimise and monitor the operation of the road paver, e.g., in a closed loop by means of the actual degree of compaction produced, whereby in this loop, operational parameters are, e.g., automatically, changed with regard to the particular compaction of the asphalt layer determined on the screed and the result of the changes can be read immediately in the actual degree of compaction. Altogether, in this way the personnel on the road paver, each compacting device and even at the mixer, can be relieved significantly.

In an expedient embodiment, either the material density module is arranged on the road paver or at least a data-obtaining part of the material density module is arranged on the road paver and a further part is positioned separated from the road paver in a stationary or mobile manner, whereby in the latter case, communication links are expediently provided between the parts. In this way, the road paver itself can be operationally optimised and the road paver that lays down the asphalt layer can function as the master for peripheral accessory devices and guide them.

Expediently, at least actual degree of compaction measuring devices, particularly probes, are installed on the screed and connected to the material density module so that the data regarding the actual degree of compaction can, in real time, be practically obtained, evaluated and/or documented.

In an alternative embodiment, the actual degree of compaction of the asphalt layer is indirectly determined by means of the material density module through sampling and converting operational parameters of at least one compacting tool, preferably taking into consideration the composition of the asphalt material delivered to the road paver from the mixer. For example, the actual degree of compaction produced by the tamper can consequently be determined from the stroke and frequency of the tamper, or the actual degree of compaction produced by the screed plate can be deducted from the frequency of the screed plate that is provided with the vibration device, or the actual degree of compaction present after the pressure bar can be relatively precisely determined from the hydraulic impact pressure of the respective pressure bar, the frequency of the pressure pulses and/or the penetration depth and/or acceleration of the pressure bar with each stroke.

In a further expedient embodiment, a calculating section is provided for a mathematical determination of the respective actual degree of compaction of the asphalt layer. This can relatively precisely determine and evaluate the actual degree of compaction from the paved mass per pavement length unit, preferably taking into consideration the layer thickness and the paving width. The calculating section can be a part of the material density module or it can communicate with this module in a distributed manner.

A further possibility consists of calculating the actual degree of compaction by means of the material density module in a numerical way each time, particularly by means of at least one neuronal network.

In an expedient embodiment, the road paver has a navigation system that is linked to the material density module. In this way, each of the actual degrees of compaction determined by the material density module can be combined at least with position data, preferably also with obtained layer and/or time and/or temperature information, that, for example, are meaningful for the compacting device and that also can take into consideration an operational delay until the final compacting at the respective position during the adjustment of the compaction power.

In order to be able to process the data as rapidly as possible and also to be able to process many items of data efficiently, it can be expedient if the material density module is connected to a central computer, preferably a server, that preferably is positioned on the road paver or is positioned separately from this in a stationary or mobile manner.

In a further embodiment, it is expedient, preferably for operational optimisation of the screed by means of the material density module, to vary operational parameters such as at least the frequency, stroke, pressure bar impact pressure, penetration depth and optionally even the heating output for the same of the compacting tools, at least taking into consideration the temperature of the asphalt material or the predetermined final degree of compaction. By means of this operational optimisation, a uniformly high, scarcely fluctuating actual degree of compaction is achieved without considerable stress for the personnel, so that the compacting device only has to apply a little power or execute a few passages.

In a further embodiment, for operational optimisation of the road paver and, preferably, by means of the material density module, at least one operational parameter of the road paver, such as at least the paving speed and/or the material throughput to the screed and/or the distribution auger rotational speed and/or power, is varied, which preferably can take place with consideration given to the temperature of the delivered asphalt material and/or the predetermined final degree of compaction. This in turn is advantageous in view of the fact that later the compacting device has to produce only a low compaction power or execute only a few passages in order to ensure the desired final degree of compaction as constantly as possible.

It can furthermore be expedient to determine the respective actual degree of compaction for one compacting tool as an average value across the paving width of the asphalt layer or across a significant portion of the same. In this way, it is possible to compensate for local outliers.

In a further embodiment, data communication links are provided between the material density module and, directly or indirectly, the mixer and/or the compacting device, in order either, on the basis of communicated data, to know the compaction power at the respective position expected by the compacting device in advance and then adjust it without being pressed for time and/or to inform the mixer should the temperature of the delivered asphalt material fall short of or exceed predetermined limits.

In an expedient embodiment the screed has at least two compacting tools from the following group that come into action during the laying process in successive stages in the paving driving direction: at least one tamper, at least one screed plate with a vibration device, at least one hydraulically operated pressure bar, whereby the actual degree of compaction can be obtained after at least one stage or after every stage or after the last stage by means of the material density module.

With a view to efficient construction site management, it can be advantageous to assign the material density module at least one documentation module that stores information and/or data. In this way, data sets regarding optimal working conditions or basic settings of parameters can be held available that can be retrieved later at other construction sites and used under similar paving conditions.

With a view to efficient construction site management, it can be advantageous if the compacting device has its own on-board or an external compaction management system, also for processing data communicated by the material density module of the road paver, preferably with a monitoring and/or documentation section, at least for the final degree of compaction of the asphalt layer and/or for the applied compaction power. The system works either largely automatically or it guides the respective operator.

BRIEF DESCRIPTION OF THE DRAWING

Embodiments of the object of the invention are explained on the basis of the drawings. Shown are.

DETAILED DESCRIPTION OF THE INVENTION

Figure 1:
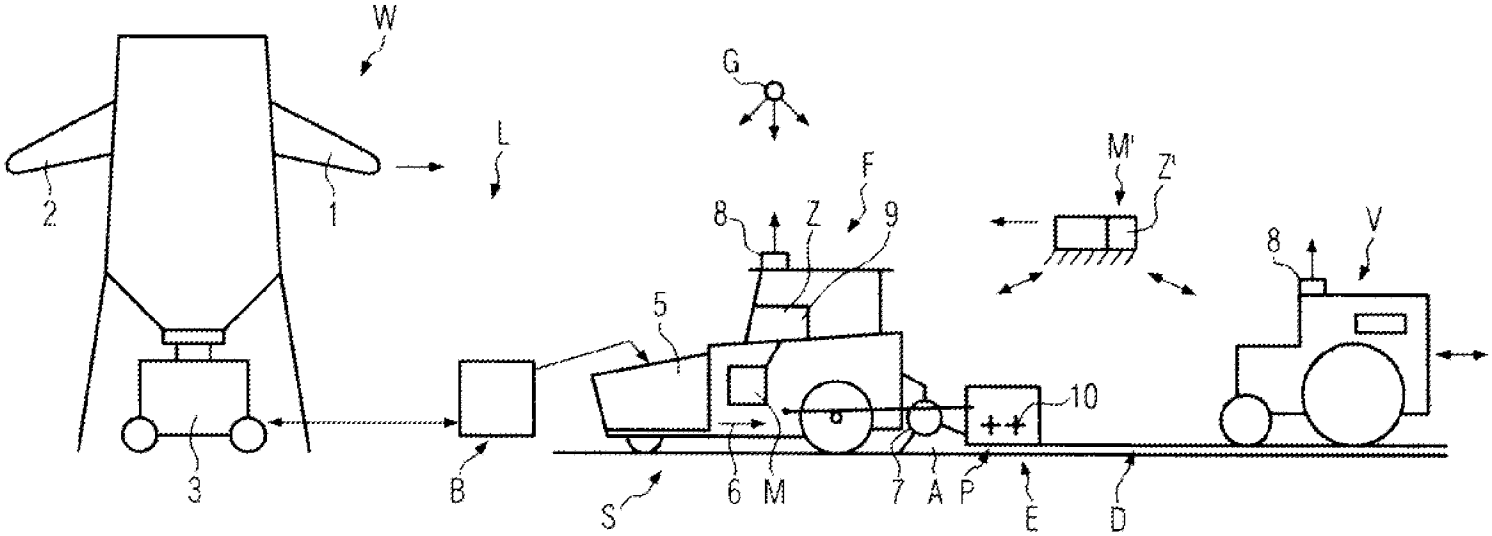
FIG. 1 schematic depiction of a system for laying down an asphalt layer of asphalt material at a construction site with basic components of a construction site management system, FIG. 2 a cross-section of an asphalt layer that has been laid down, FIG. 3 a sectional view of an embodiment of a screed of a road paver of the system, FIG. 4 a cross-section of another embodiment of a screed of a road paver of the system, and FIG. 5 a perspective view of a part of the construction site, for example, from FIG. 1.

In FIG. 1, a schematically indicated system S for laying down an asphalt layer D at a construction site comprises, for example, an asphalt material mixer W, at least one road paver F with at least one screed E, and at least one mobile compacting device V. A delivery path L for an asphalt material A, prepared in the mixer W with a particular composition and/or temperature, extends between the mixer W and the road paver F, whereby this asphalt material A is conveyed by means of the lorry 3 and is delivered by each lorry directly to the road paver F, or with the use of a feeder B that drives in front of the road paver F. At the construction site, a plurality of road pavers F and/or also a plurality of compacting devices V can be driven simultaneously.

The mixer W has feeder devices 1, 2 for manufacturing a particular composition of the asphalt material A that is filled into the respective lorry 3 at an adjustable temperature and composition. The delivered asphalt material A has a temperature that depends, e.g., on the length of the delivery path L and/or on the environmental conditions, and it is filled into a hopper 5 of the road paver F either from the respective lorry 3 or from the feeder B. The asphalt material A is brought from the hopper 5 back to a distribution auger 7 by a longitudinal conveyor 6, whereby the distribution auger 7 can be driven with an adjustable rotational speed and/or output, and the asphalt material A that is thrown out is distributed across the foundation in front of a screed E that can be adjusted by means of a levelling cylinder on the road paver F. The road paver F has a navigation system 8, an electronic controller 9 with, for example, a central computer Z, and, expediently, its own on-board material density module M, with which, for example, by means of measuring devices such as probes 10 on the road paver F and/or the screed E, the actual degree of compaction really produced by the screed E can be obtained at a respective position in the asphalt layer D, evaluated and, e.g., documented in the form of data. The material density module M is, e.g., formed from at least one electronic hardware module at a slot e.g., in the controller 9 and/or at the central computer Z, and corresponding hardware.

The respective compacting device V likewise has a navigation system 8 and can have a compacting management system K, for example, its own on-board unit.

Alternatively, the material density module M or a portion M' of it can be positioned separated from the road paver F in a stationary or mobile manner, as can also a further central computer Z', for example, a server, whereby the latter components communicate with each other and optionally with the compacting device V or the mixer W via communication links, in either a wired or wireless manner.

Using at least the, preferably electronic, material density module M of the road paver F, its operation can be optimised and/or monitored and documented, because the respective determined and obtained actual degree of compaction at the screed provides information regarding how the screed E is working, so that, for example, in loop control that is closed by the actual degree of compaction, operational parameters of the screed E can be varied with a view to an optimal and/or desired work result. Operational parameters of the road paver F, such as the paving speed, the throughput rate of the longitudinal conveyor 6 and/or the rotational speed and/or performance and/or height adjustment of the lateral distribution auger 7, can also be optimised, monitored and/or documented in this way. Further operational parameters to be optimised in this way could be, for example, the heating outputs of the compacting tools in the screed E that process the asphalt layer D, whereby these tools produce the respective actual degree of compaction at a particular position P of the asphalt layer D, or height adjustments of the levelling cylinders for the screed E.

Measuring devices, not shown, can determine the temperature of the asphalt material delivered to the road paver F and also supply such data at least to the material density module M that also communicates with the navigation system 8, in order to combine the respective determined actual degree of compaction of the asphalt layer D with position and/or time and/or layer and/or temperature information. The compacting device V can consequently be informed in advance before it reaches the respective position P. In this way, the compaction power necessary can be determined in advance for the compacting device V, based on the actual degree of compaction, namely without there being a shortage of time, so that the compacting device V later produces only the exact compaction power required or carries out exactly the number of passages required to achieve the predetermined final degree of compaction based on the actual degree of compaction. As a result, an extraordinary uniform, high final degree of compaction of the asphalt layer is achieved efficiently and economically, whereby not only the operation of the road paver can be optimised, but also the operation of the compacting device, and also the mixer can be informed when values fall below or exceed particular limiting values (e.g., the temperature of the delivered asphalt material A). In the mixer W, the decisive operational parameters can be adjusted or optimised, whereby the time delay caused by the delivery path L until optimal asphalt material is available at the road paver F again has an effect.

Figure 2:
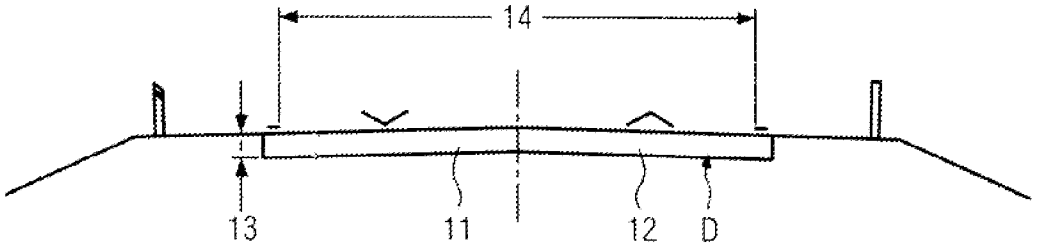

FIG. 2 is a cross-section of an example of the laid asphalt layer D that has a layer thickness 13, a paving width 14 and sections 11, 12 that are arrayed at different angles on either side of the middle. The asphalt layer D is laid by the road paver F and the screed E, namely with an actual degree of compaction that is as uniform as possible across the paving width 14, and is later given the final compacting by the compacting device V, whereby the cross-sectional profile must be maintained as shown, and the compacting device is not permitted under any circumstances to do the final compacting at positions in which a critical temperature range that does not guarantee the final compaction prevails. Precautions can be reliably taken against this risk by means of the information communicated by the material density module M (also temperature information).

Figure 3:
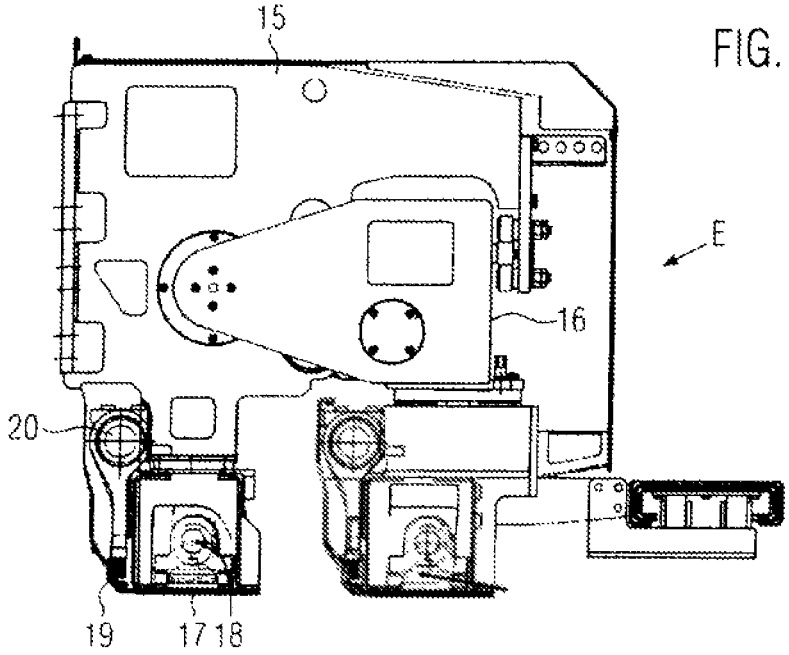

The screed E in FIG. 3 is an extendable screed with a basic screed part 15 and extendable screeds 16 that can be driven out from the sides and that allow a change in the paving width 14. Alternatively, a screed E with a paving width that cannot be changed could also be used (not shown). The basic screed 15, as well as each extendable screed 16, has a screed plate 17 on the bottom side, on which is arranged at least a vibration device 18 that can be operated with a selectable rotation speed, so that the screed plate 17 works as a compacting tool in a stage of the screed E. A further compacting tool is a tamper having at least one tamper bar 19 with an eccentric drive 20 whose rotational speed and/or eccentricity (i.e., stroke) is selectable, whereby the tamper 19 is brought into the foremost stage in the paving driving direction (from right to left in FIG. 3) and in front of the screed plate 17 in order to act on the asphalt material A (two compacting tools 17, 19 or stages).

Figure 4:
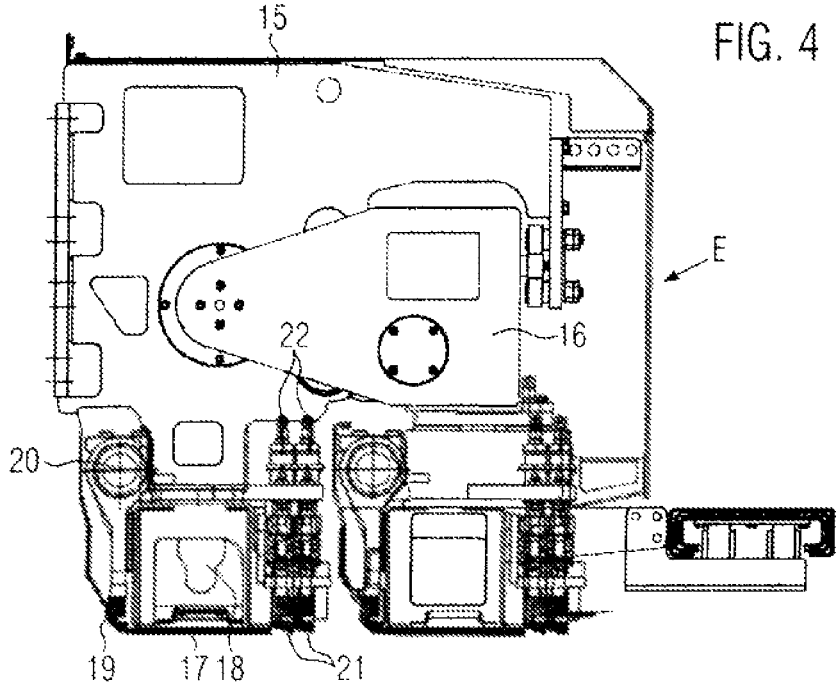

The screed shown in FIG. 4 is likewise an extendable screed with a basic screed 15 and extendable screeds 16, but it could also be (not shown) a screed with a fixed paving width.

In the screed E in FIG. 4, the basic screed 15 and also each extendable screed 16 has a third stage with a further compacting tool that here is formed by at least one pressure bar 21 (here two, one behind the other), that can be operated by means of a hydraulic drive 22 with vertical pressure pulses and optionally adjustable acceleration and that works behind the screed plate 17 in the paving driving direction. Three stages for compacting the asphalt layer D are consequently provided here. Although an actual degree of compaction of even approximately 98% can be produced with the screed in FIG. 4 due to the at least one pressure bar 21, in practice, the laid asphalt layer D is nevertheless as a rule given a final compaction by at least one compacting device V (FIG. 1).

Figure 5:
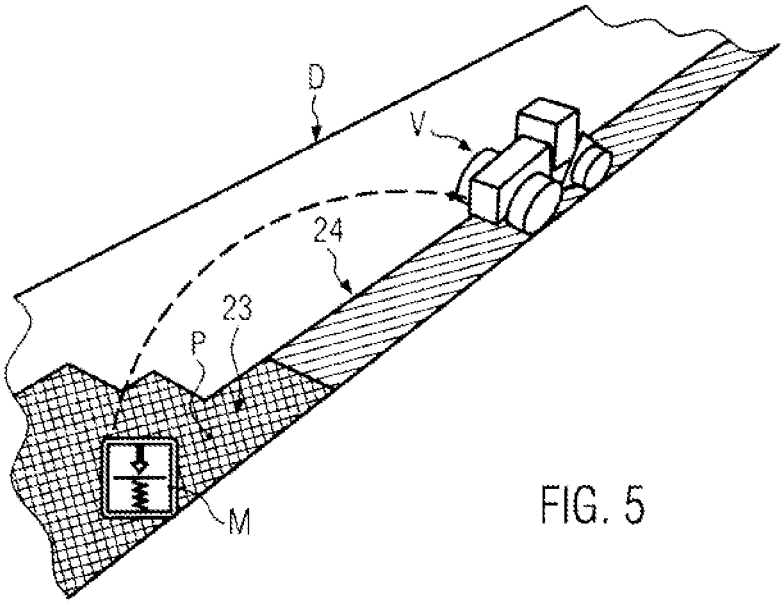

FIG. 5 schematically indicates a part of the construction site on which the road paver, not shown, has laid down the asphalt layer D, whereby the actual degree of compaction at the respective position P is determined and evaluated by means of the material density module M. The different actual degrees of compaction are indicated by different colourings 23, 24. The compacting device V drives to the respective position P with recourse to the data communicated by the material density module M, and thereby applies only the amount of compaction power that is required there to achieve the predetermined final degree of compaction based on the communicated actual degree of compaction. Temperature information can also be supplied for the respective positions P, for example, to the compacting management system K.

The actual degree of compaction measuring devices 10 indicated on the screed E in FIG. 1 can, for example, be probes distributed across the paving width that are connected to the material density module M in a manner that allows the measured values to be transferred, and that expediently tap and communicate the actual degree of compaction of each stage of the compacting tools 17, 19, 21 or the actual degree of compaction present at the respective position P after the last stage (screed plate 17 or pressure bar 21). A plurality of probes can hereby be provided across the paving driving direction in order to determine an average value of the actual degree of compaction.

The actual degree of compaction can alternatively also be determined indirectly by tapping operational parameters, for example, of the compacting tools 17, 19, 21, for example, via the stroke and frequency of the tamper 19, the frequency and performance of the vibration device 18 or the hydraulic impact pressure and/or the frequency of the pressure pulses and/or the penetration depth and/or acceleration of each pressure bar 21, for example, on the basis of the mass of asphalt material A laid down per paving path length unit. The composition and optionally temperature of the delivered asphalt material are also preferably taken into account here.

Alternatively, the respective actual degree of compaction can also be calculated numerically, for example, by means of at least one neuronal network, whereby, for example, the central computer Z or Z can be enlisted for calculating processes and, expediently, a documentation module, not shown, can be assigned to the material density module M, in which documentation module data and/or information is documented and stored.

In the determination of the paved mass per paved distance length unit by calculation, the layer thickness 13 and the paving width 14 at the respective position P or across the paving distance length unit are also expediently taken into consideration, optionally in turn with the inclusion of the temperature of the asphalt material delivered to the road paver F.

Taking into consideration the actual degree of compaction obtained by the material density module M after each level, other operational parameters of the road paver can be optimised, for example, the paving driving speed, the throughput of the longitudinal conveyor 6 and/or the rotational speed and/or performance and/or height position of the lateral distribution auger 7 on the road paver F, the set angle of the screed, e.g., by means of the levelling cylinders, and optionally even the heating output of heating devices of the compacting tools. The actual degree of compaction after the first stage (tamper 19) is, for example, a meaningful quantity for the greatest possible maintenance of the set angle of the screed E, that is adjusted by means of the levelling cylinders (not shown) on the road paver F and that is a factor that is decisive for the evenness of the asphalt layer D.

Like the temperature, the density of the asphalt material A also changes during the processing. After the mixing process, the asphalt material A has its bulk density, which changes slightly during transport in the supply chain L, before, based on the bulk density at the screed, a multiple-stage compacting process takes place. The subsequent final compaction by the compacting device V can be static gravitational, vibratory or oscillation compaction. Asphalt rollers compact in two stages per passage, because they have two drums (wheel sets), whereby each roller can pass over each position of the asphalt layer a plurality of times.

In order to be able to select the operational parameters of the compacting tools 17, 19, 21 to optimize the operation of the screed E, the temperature and the density achieved by the time of the effect of the respective compacting tool or the existing actual degree of compaction are important pieces of information. This information allows the operation of the compacting tools 17, 19, 21 to be, so to speak, read off. At least some of the abovementioned operational parameters can consequently be changed, e.g., in a control loop that is closed by the actual degree of compaction, until the result confirms a desired optimum or regains it. This can be, for example, a relatively high and very uniform actual degree of compaction so that the compacting device V only has to apply a little power that is as uniform as possible.

The material density module M determines or obtains the actual degree of compaction expediently after each stage and transfers this, for example, with position, layer, time and temperature information, to the central computer Z or Z', which is, for example, a server. A documentation module can store the information of the material density module M. The central computer Z of the road paver F knows the processed mass, for example, in kilogram/meter or kilogram/square meter because these data are provided, e.g., by means of a construction site management system. Because the central computer Z also knows the layer thickness 13 and the paving width 14, these parameters can also be consulted for determining the respective actual degree of compaction. For example, the actual degree of compaction produced after the last compaction stage is documented with regard to position using the navigation system (satellite navigation system G) and communicated to the respective compacting device V, for example, combined with the time, temperature or layer information. The compaction management system K can be used by the compacting device V, e.g., for monitoring and documenting the final degree of compaction, whereby the compacting device V accesses the communicated data of the material density module M of the road paver F and produces only the necessary compaction power at the respective position P. Based on the determined actual degree of compaction indicated in FIG. 5 with the already rather uniform colouring in 23, the compacting device V produces the final compacting indicated by the uniform colouring in 24. In this way, the result is a smooth course of action at the construction site, whereby the risks of damage and/or personal injuries are minimised, and above all the operating personnel in the mixer and/or on the road paver F and/or on the respective compacting device V are relieved as far as possible with regard to operational optimisation and monitoring. The final work results are documented and verifiable, as are, e.g., the operational parameters and driving route information, the processed asphalt material and the like, optionally also faults and the like. The documented data can be used later at another construction site with similar prerequisites in a time-saving manner, at least for the basic adjustment of operational parameters.

The invention claimed is:

1. An apparatus for laying down an asphalt layer made of asphalt material during a paving operation, comprising a road paver having at least one screed including at least one compacting tool, a self-propelled compacting device capable of producing a predetermined final degree of compaction in the asphalt layer, and an electronic material density module functionally associated with the road paver, the electronic material density module collecting data during the paving operation of the asphalt layer to determine an actual degree of compaction produced in the area of at least one of the compacting tools, the road paver having a navigation apparatus linked to the electronic material density module for obtaining position data of the area of the asphalt layer, and combining the actual degree of compaction of the asphalt layer in the area of the asphalt layer determined by the electronic material density module with the obtained position data, and wherein data communication links are provided between the electronic material density module and the compacting device for carrying data for use in adjusting a compaction power required by the compacting device in order to produce the final degree of compaction at the respective area of the asphalt layer.

2. The apparatus according to claim 1 wherein the electronic material density module is located on the road.

3. The apparatus according to claim 1 wherein the screed has devices for measuring the actual degree of compaction on the asphalt layer, the devices being connected to the electronic material density module for transferring measured values.

4. The apparatus according to claim 1 wherein the actual degree of compaction in the area of the asphalt layer is determined by the electronic material density module indirectly by means of sampling and converting operational parameters of at least one of the compacting tools of the screed.

5. The apparatus according to claim 1 wherein the electronic material density module contains a calculating section or is connected to a calculating section for mathematically determining the actual degree of compaction in the area of the asphalt layer from an asphalt mass laid down by the road paver per paved distance length unit.

6. The apparatus according to claim 1 wherein the electronic material density module has a neuronal network for determining mathematically directly or indirectly the actual degree of compaction in the area of the asphalt layer.

7. The apparatus according to claim 1, wherein a data-obtaining part of the electronic material density module is located on the road paver and a further part of the material density module is located apart from the road paver in a stationary position or a mobile position.

8. The apparatus according to claim 1 wherein the electronic material density module is capable of collecting and processing data used to control operational parameters including at least one of the paving speed of the road paver, the asphalt material throughput in the road paver to the screed, a distribution auger rotational speed, a distribution auger output, and an angle of attack of the screed.

9. The apparatus according to claim 1 wherein the electronic material density module is capable of determining the actual degree of compaction in the area of the asphalt layer as an average value across a paving width or across a significant portion of the paving width of the asphalt layer.

10. The apparatus according to claim 1 wherein the screed has at least two compacting tools operating sequentially in a paving travelling direction during the paving operation and selected from a group consisting of at least one tamper, at least one screed plate with a vibration device, and at least one hydraulically operated pressure bar.

11. The apparatus according to claim 1 wherein the compacting device has a compaction management apparatus for processing data communicated via the communication links by the electronic material density module of the road paver.

12. An apparatus for laying down an asphalt layer made of asphalt material during a paving operation, which comprises:

at least one road paver having at least one screed including compacting tools, at least one self-propelled compacting device, capable of producing a predetermined final degree of compaction of the asphalt layer by exerting a compaction power, an asphalt mixer, an electronic material density module functionality associated with the road paver, at least one probe on the screed collecting data during the paving operation on actual degree of compaction of the asphalt layer produced in the area of at least one of the compacting tools, and transmitting the determined data to the electronic material density module for processing and evaluation by the electronic material density module and for communicating the determined data to the compacting device for adjusting the compacting input power in order to produce the predetermined final degree of compaction in the asphalt layer and in the area of the asphalt layer.

* * * * *